US006138558A

United States Patent [19]

Harrington

[11] Patent Number: 6,138,558

[45] **Date of Patent: *Oct. 31, 2000**

[54] TRASH AND RECYCLING CENTER

[76] Inventor: John Harrington, 5118 Hialeah, Houston, Tex. 77092

[ * ] Notice: This patent issued on a continued prosecution application filed under 37 CFR 1.53(d), and is subject to the twenty year patent term provisions of 35 U.S.C. 154(a)(2).

[21] Appl. No.: 08/453,619

[22] Filed: May 30, 1995

Related U.S. Application Data

[62] Division of application No. 08/027,922, Mar. 8, 1993, Pat. No. 5,718,168, which is a continuation of application No. 07/737,330, Jul. 29, 1991, abandoned.

[51] Int. Cl.[7] ..... B30B 9/32

[52] U.S. Cl. ..... 100/102; 232/43.1; 232/43.2; 100/902

[58] Field of Search ..... 100/91, 102, 226, 100/902; 220/908, 909; 232/43.1, 43.2

[56] References Cited

U.S. PATENT DOCUMENTS

| | | | |
|---|---|---|---|
| D. 304,873 | 11/1989 | Ruehland | D34/5 |
| 581,322 | 4/1897 | Winters | 232/43.2 |
| 988,751 | 4/1911 | Zunino | 232/43.1 |
| 1,281,587 | 10/1918 | Kovachevich | 232/43.2 |
| 1,998,263 | 4/1935 | Townsend | 100/902 |
| 2,191,488 | 2/1940 | McCowan | 100/902 |
| 2,531,444 | 11/1950 | Lane | 232/43.2 |
| 2,603,271 | 7/1952 | Heymers | 100/902 |
| 2,619,150 | 11/1952 | Smith | 100/902 |
| 3,162,496 | 12/1964 | Morgan | 232/43.2 |
| 3,285,685 | 11/1966 | Hewett | 312/287 |
| 3,351,400 | 11/1967 | Sholtes | 312/107 |
| 3,352,615 | 11/1967 | Sandin | 312/107 |
| 3,358,590 | 12/1967 | Howard | 100/245 |
| 3,411,722 | 11/1968 | Webber | 100/902 |
| 3,443,745 | 5/1969 | Kleeberg | 232/43.2 |
| 3,510,055 | 5/1970 | Safford | 232/43.2 |
| 3,658,233 | 4/1972 | Voytko | 232/43.2 |
| 3,893,615 | 7/1975 | Johnson | 232/43.2 |
| 4,002,387 | 1/1977 | Wolbrink | 100/902 |
| 4,108,065 | 8/1978 | Unger | 100/902 |
| 4,114,776 | 9/1978 | Pluss | 220/909 |
| 4,240,341 | 12/1980 | Whipple et al. | 100/902 |
| 4,301,722 | 11/1981 | Balbo et al. | 100/902 |
| 4,483,248 | 11/1984 | Ostreng | 100/902 |
| 4,653,627 | 3/1987 | Hampson et al. | 100/902 |
| 4,660,758 | 4/1987 | Tavel et al. | 232/43.2 |
| 4,750,639 | 6/1988 | Schaerer | 220/410 |
| 4,860,910 | 8/1989 | Zipper | 220/909 |
| 4,893,722 | 1/1990 | Jones | 232/43.1 |
| 4,927,085 | 5/1990 | Oberg | 100/902 |
| 4,988,010 | 1/1991 | Pollak | 220/909 |
| 5,048,413 | 9/1991 | Deiters | 100/902 |
| 5,050,755 | 9/1991 | Strawder | 220/909 |
| 5,060,564 | 10/1991 | Buford et al. | 100/902 |
| 5,072,852 | 12/1991 | Smith et al. | 220/909 |
| 5,076,458 | 12/1991 | Weiner et al. | 232/43.2 |
| 5,105,968 | 4/1992 | Fiterman et al. | 232/43.2 |

FOREIGN PATENT DOCUMENTS 857578 12/1960 United Kingdom .

OTHER PUBLICATIONS

Advertisement, "The Container Store", 1990, The Container Store, Texas, one page, 1990.

*Primary Examiner*—Stephen F. Gerrity
*Attorney, Agent, or Firm*—Mark F. Harrington

[57] ABSTRACT

A trash and recycling center having a modular trash receptacle unit and a modular recycling receptacle. The trash receptacle unit has at least two interior compartments and a movable lid. A trash bag can be placed in one compartment and used newspapers can be stored in the other compartment. The recycling receptacle unit has a top with a can crusher, an empty can storage area, and a slot for depositing crushed cans into the interior of the recycling receptacle. The interior of the recycling receptacle can have multiple shelves or storage draws or, can have a single storage bin. The recycling receptacle can also have a removable counter top recycling unit.

20 Claims, 7 Drawing Sheets

TRASH AND RECYCLING CENTER

CROSS-REFERENCE TO RELATED APPLICATIONS

This is a divisional patent application of Ser. No. 08/027,922, filed Mar. 3, 1993 (now U.S. Pat. No. 5,718,168), which is a continuation of Ser. No. 07/737,330, filed Jul. 29, 1991, now abandoned.

BACKGROUND OF THE INVENTION

1. Field of the Invention

The present invention relates to receptacles and, more particularly, to a combined trash and recycling center.

2. Prior Art

There are different types, shapes, and sizes of trash and recycling receptacles known in the prior art. U.S. Pat. No. 4,660,758 to Tavel et al. discloses one type of receptacle in addition to other containers described in it's Description of the Prior Art. Other containers and receptacles can also be found described in the following U.S. Pat. Nos. DES 304,873; 4,860,910; 4,750,639; and 4,114,776.

Due to environmental concerns and the decrease in the number of available landfills for common household trash, many family households now collect recyclable articles such as newspapers, beverage cans and other types of metal, plastic and glass containers. This material accumulates or is collected and either brought to a recycling center or collected by a municipal or neighborhood association collection truck at curbside. However, a problem exists with the prior art in that no suitable type of means has been provided to conveniently and efficiently collect and store recyclable material in the home prior to collection at curbside or prior to transportation to a recycling center.

A further problem exists in that no suitable system is provided for collection and storage of both recyclable material and other nonrecyclable trash for use in the home that does not take excessive floor space or is otherwise inconvenient, such as having to store the materials in the garage or other remote storage site away from the generation site or source.

A further problem exists in that no suitable system has been provided that can be adapted to particular needs and requirements of different households. This is particularly evident when comparing the needs and requirements of a family having a large number of members with a spacious house versus a single member household in an apartment setting. No acceptable single system has been provided in the past to accommodate both of these situations and, that can be modularly increased or reduced to accommodate changes in situations such as the expansion or reduction in the size of a family and/or their living area.

It is therefore an objective of the present invention to overcome problems in the prior art and provide a new and improved trash collection and/or recycling collection system.

SUMMARY OF THE INVENTION

The foregoing problems are overcome and other advantages are provided by a new and improved trash and/or recycling center.

In accordance with one embodiment of the present invention, a recycling receptacle is provided having a housing, means for removably mounting a can crusher to the housing, and a storage container. The housing has a top and side walls forming an interior chamber. The can crusher is connected to the housing. The storage container is removably contained in the interior chamber.

In accordance with another embodiment of the present invention, a recycling receptacle is provided having a housing and at least one container. The housing has a top and side walls forming and interior storage area. The top has a slot for transporting articles into the interior storage area and an article staging area for temporarily storing articles on the top prior to insertion into the slot. The staging area includes a raised lip. The container is removably positioned in the interior storage area for receiving articles deposited into the interior storage area through the slot.

In accordance with another embodiment of the present invention, a table top recycling receptacle is provided having a housing, a can crusher, and means for removably storing cans inside the housing. The can crusher is connected to the housing.

In accordance with another embodiment of the present invention, a trash receptacle is provided having a housing, a lid, and a side door. The housing has a top with an aperture and forms first and second interior chambers. The first chamber communicates with the aperture and the second chamber is located below the first chamber. The lid is movably mounted to the housing proximate the aperture. The lid is adapted to substantially close the aperture in a first position and is movable on the housing to a second position to access the first chamber through the aperture. The side door is movably connected to the housing for accessing the second chamber.

In accordance with another embodiment of the present invention, a trash receptacle is provided having a housing and a top section. The housing has an interior recess. The top section is connected to the housing and has a frame, a movable flap, and a removable compost container. The frame is connected to the housing and has first and second apertures through a top of the frame. The movable flap is located at the first aperture. The removable compost container is at least partially mounted in the second aperture and has a lip positioned on the frame top and a cover adapted to seal the container.

In accordance with another embodiment of the present invention, a combined trash and recycling receptacle is provided having a housing, a top, a first container and means for positioning a trash bag. The housing forms first and second interior recesses. The top is connected to the housing and has a can crusher located above the first recess and a movable lid over the second recess. The first container is removably positioned in the first recess. The means for positioning a trash bag can position the trash bag under the lid.

In accordance with another embodiment of the present invention, a combined trash and recycling receptacle is provided having a first modular unit, a second modular unit, and means for removably connecting the modular units. The first modular unit has a first housing with a can crusher and a removable container inside the housing. The second modular unit has a second housing with a movable lid and means for positioning a trash bag in an interior chamber thereof.

BRIEF DESCRIPTION OF THE DRAWINGS

The foregoing aspects and other features of the present invention are explained in the following description, taken in connection with the accompanying drawings, wherein.

DETAILED DESCRIPTION OF THE INVENTION

Figure 1:
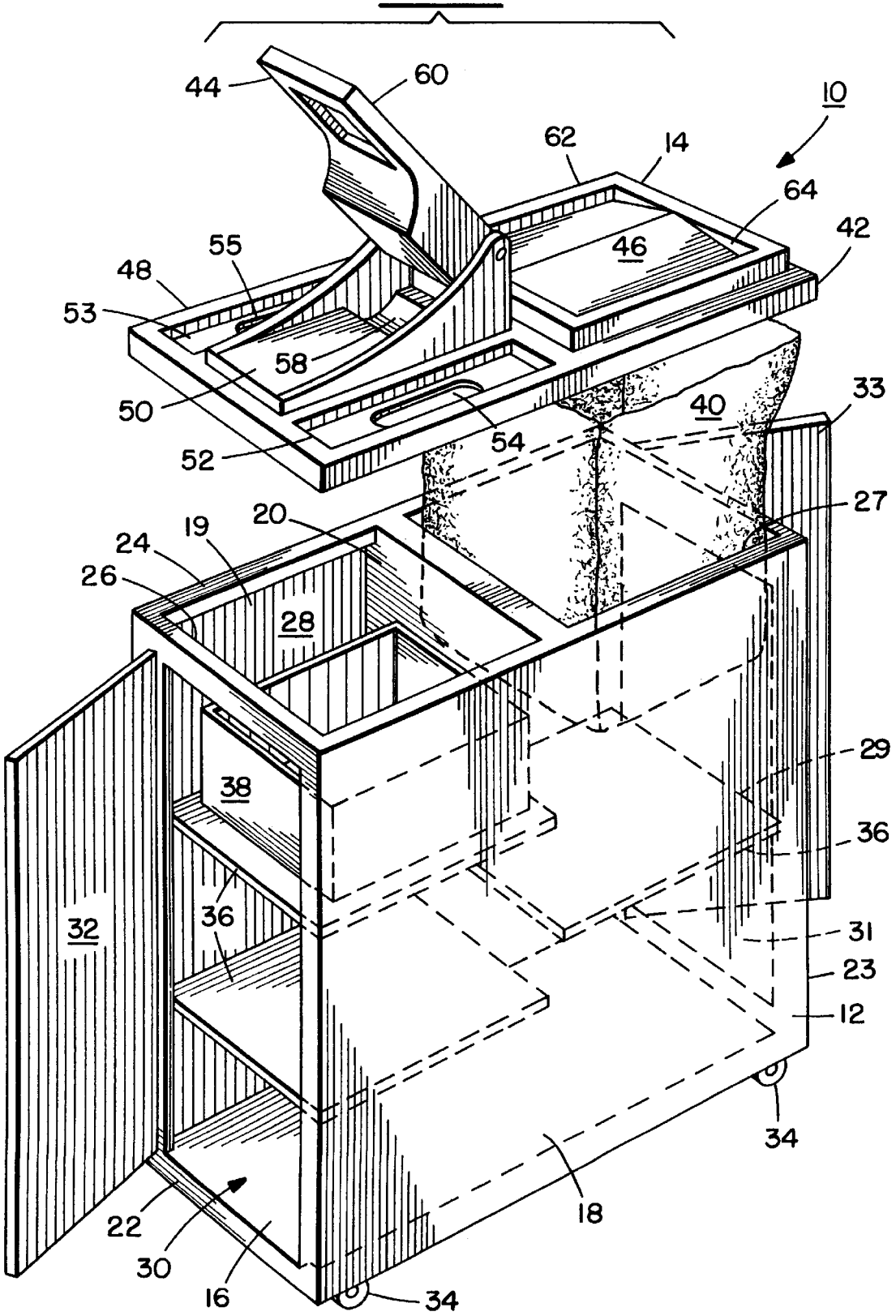
FIG. 1 is an exploded perspective view of one embodiment of a system incorporating features of the present invention.

Referring to FIG. 1, there is shown one embodiment of a trash and recycling center 10 incorporating features of the present invention. Although the present invention will be described with reference to the various embodiments and features shown in the drawings, it should be understood that the present invention can be incorporated into many alternate different types of embodiments. In addition, any suitable size, shape, or type of elements or materials could be used in various different types of embodiments.

In the embodiment shown, the center 10 includes a housing 12 and a top 14. The housing 12 can be made of any suitable type of material or combination of materials including wood, metal, plastic and glass. The housing 12, in the embodiment shown, is a unitary structure having a base 16, side walls 18 and 19, a center partition 20 between the side walls 18 and 19, end walls 22 and 23 between the side walls 18 and 19, and a top surface 24 with two holes or apertures 26 and 27. The housing 12 establishes two interior chambers 28 and 29; one on each side of the center partition 20. Each one of the holes 26 and 27 provides access to one of the chambers 28 and 29. The end walls 22 and 23, in the embodiment shown, each have an opening 30 and 31. Doors 32 and 33 are hingedly mounted to the ends walls 22 and 23. The base 16 has rollers 34 such that the center 10 can be relatively easily relocated or moved. A suitable lock could be provided to prevent the rollers from moving unless desired. Alternatively, the center 10 need not have rollers 34, but may instead be intended to be stationarily positioned in a suitable area such as a corner of a domestic kitchen.

Located in each of the chambers 28 and 29, in the embodiment shown, are shelves 36. The left chamber 28 has two shelves 36 with the top of the base 16 acting as a third shelf. The right chamber 29 has one shelf 36 and the top of the base 16 also acts as another shelf in the right chamber. The shelves are fixed to the housing 12, but may also be removable or repositionable. The shelves 36 in the left chamber 28 are suitably spaced from each other to establish three compartmental areas that can removably support containers 38 on their top surfaces. In a preferred embodiment, each container 38 would be used to collect and store different types of recyclable materials such as metal, glass and plastic. The user can simply use the door 32 to deposit articles into the containers 38 and to remove full containers from the center 10. In an alternate embodiment, the containers 38 may be provided as removable sliding drawers. The substantially enclosed nature of the left chamber 28 and use of the door 32 help to keep the recyclable items out of visual sight and limit or control the discharge of odors.

The right chamber 29 establishes two compartmental areas because of its shelf 36. The top area is used to receive a trash bag 40. The top surface of the shelf 36 can support the bottom of the trash bag 40. The bottom area of the right chamber 29 is generally intended to store other articles such as used newspapers intended to be recycled or can store additional unused trash bags. Once again, the nature of the enclosed right chamber 29, similar to the left chamber 28, and the use of door 33 help to keep the articles in the right chamber 29 out of visual sight.

The top 14 can be comprised of any suitable type of material or combination of materials. The top 14 can be fixedly connected to the top surface 24 of the housing 12 or, may be removably mounted thereto. In the embodiment shown, the top 14 has a base frame 42, a can crushing lever 44 and a trash lid 46. In a preferred embodiment, the top 14 is provided with suitable means, such as lugs or posts for removably mounting a can crusher to the top. Suitable means may be provided to fix the can crusher to the top and various different crushing devices are known in the art that are available for this purpose. These crushing devices are sold as separate items and are generally intended to be mounted by screws or the like to a wall. The removable nature of the crusher of the present invention provides for ease of cleansing. In the embodiment shown, the frame 42 is comprised of a single piece of molded plastic or polymer material. The base frame 42 has a left section 48 with a molded can crusher base section 50 and two can staging areas 52 and 53 on opposite sides of base section 50. In the embodiment shown, each of the staging areas 52 and 53 is recessed into the base frame 42 such that a lip or face of the base frame establishes the staging area 52. In a preferred embodiment, the width of each staging area is about the same as the outer diameter of a beverage or soda can and the length of each staging area is adapted to receive about four to six cans in an upright position with their bases in the staging area such that the staging areas can hold about eight to twelve cans. However, any suitable type of staging area can be provided. In the embodiment shown, each staging area 52 and 53 also comprises a slot 54 and 55 that passes through the base frame 42. The width and length of the slots are sufficient to allow the passage of articles, such as crushed beverage cans and the like, therethrough. The function of the staging areas 52 and 53 is to allow a user to temporarily store empty cans on top of the center 10. The nature of the lips around the staging area provide the function of preventing upright cans from falling off of the center 10. Cans are stored in the staging areas 52 and 53 generally for two purposes. First, after cleaning a can, the can can dry on top of the center 10 to prevent liquids from being transported into the containers 38. This helps to keep the containers 38 clean and dry. Second, the cans can be stored such that a user does not need to immediately crush a can after it is emptied. Thus, a user can crush the staged cans at a later time. The center thus provides a storage area that would otherwise not be available and helps to keep a kitchen organized, clean, and allows the user to be more efficient when crushing cans all at once. For the embodiment shown, the two slots 54 and 55 are provided such that cans or used containers comprised of different materials, such as ferrous and non-ferrous materials, can be inserted into different slots. The container below the top can have a divider or two separate containers can be provided next to each other. A magnet can also be provided on the top to simplify identification of cans made of ferrous and non-ferrous materials. The two staging areas also allow separate staging of these different types of cans on the top.

Pivotally mounted to the can crusher base section 50 is the can crushing lever 44. The base section 50 and lever 44 are adapted to receive and crush a can, such as a metal beverage can, therebetween. An operator or user merely places a can in recess 58 and, by using handle 60, closes the lever 44 onto the base section 50 to compact the can for more efficient and compact storage. In the embodiment shown, the left section 48 is located over the left chamber 28. Crushed cans can be deposited through the slots 54 and 55, through the left top hole 26 in the housing 14, and dropped into the top container 38. Thus, a user need not open the door 32 to deposit an article into the top container 38.

The frame section 42 also has a right section 62. The right section 62 has a center aperture 64 therethrough and can pivotably support the lid 46 thereon. Suitable means can also be provided to support a top of the trash bag 40 therewith. Thus, trash can be deposited into the trash bag 40 by pivotably moving the lid 46 as is known in the art. The lid 46 is balanced such that it closes over the aperture 64 in a home position, also as is known in the art. The center 10 shown in FIG. 1 thus provides both functions of a household trash receptacle and a recycling receptacle in one unit. The center 10, due to its vertical positioning of recycling containers next to a trash receiving area provides a compact and efficient unit particularly well suited for use in a household kitchen that takes up minimal floor space.

Figure 2:
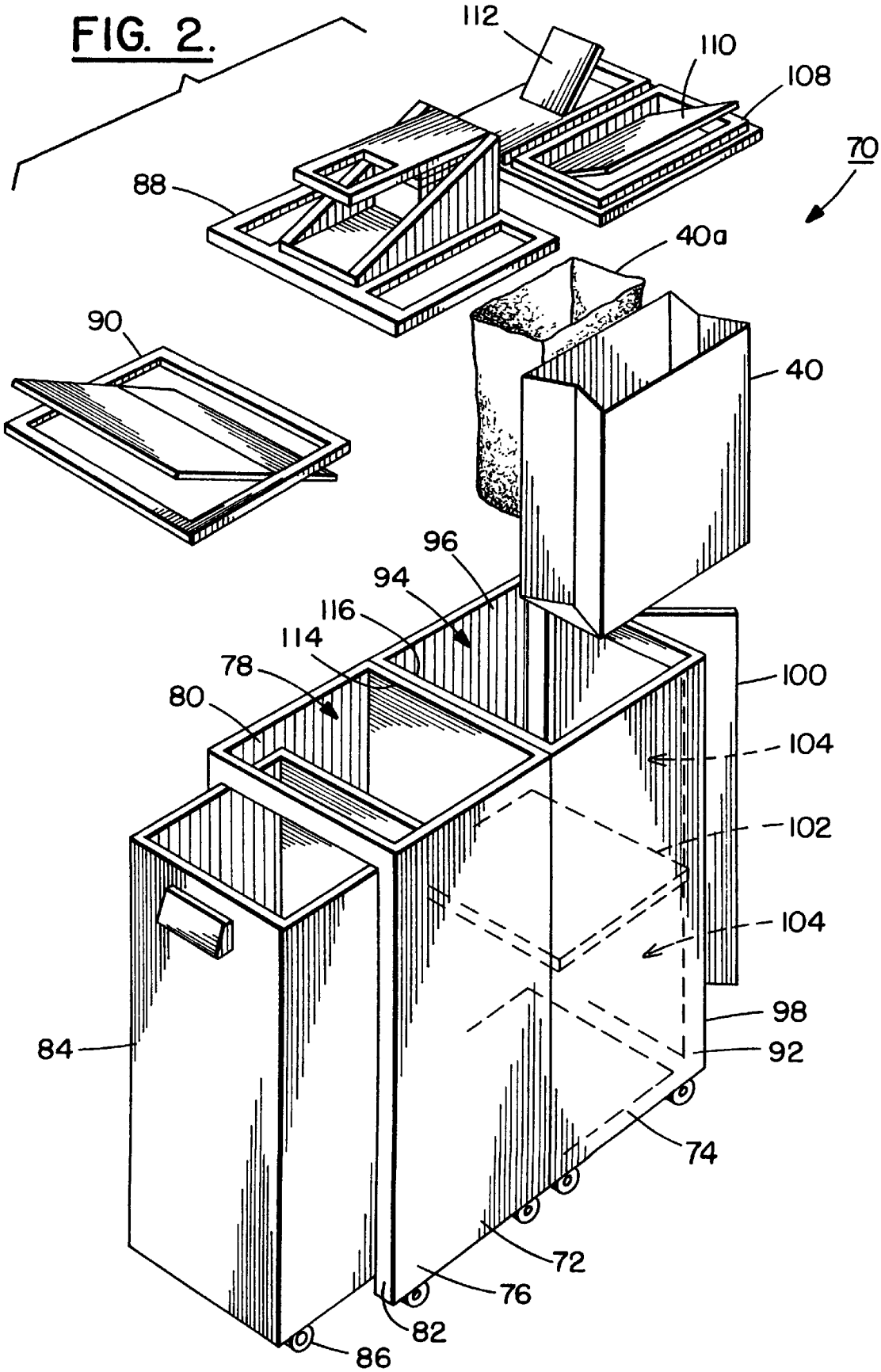
FIG. 2 is an exploded perspective view of an alternate embodiment of a system incorporating features of the present invention.

Referring now to FIG. 2, there is shown an alternate embodiment of the present invention. In the embodiment shown, the trash and recycling center 70 is comprised of various modular units. The center 70 has a recycling unit 72 and a trash unit 74 that are removably connected to each other. As well as horizontal staking of individual units next to each other, the present invention can also include vertical stacking units on top of each other. The recycling unit 72 has a frame or housing 76 that establishes a center chamber 78, an open top 80 and a substantially open end wall 82. The recycling unit 72 also has a recycling bin 84 that is removably positionable through the end wall 82 into the center chamber 78. The bin 84 is generally intended to store recyclable materials in a commingled fashion. This can be used for localities that have a commingled recyclable collection policy or where the user will later sort out the various different types of recyclables into separate bins. The bin 84 has rollers 86 such that the bin can be readily and easily transported from the center 70 to the curbside of a street for collection by a recycling collection truck. The top of the frame 76, in the embodiment shown, is adapted to modularly receive a top; top 88, top 90, top 108, or any type of suitable top. The modular tops are used such that individuals can configure the recycling unit 72 to their own particular needs or desires. The first top 88 is substantially similar to the left section 48 of the top 14 shown in FIG. 1. The second top 90 is substantially similar to the right section 62 of the top 14 shown in FIG. 1. However, any suitable type of modular top can be provided. In addition, the recycling unit 72 need not have a removable modular top, but may have a fixed top instead.

The trash unit 74 also has a housing or frame 92 that forms a center chamber 94 with an open top 96 and an open end wall 98. The unit 74 has a door 100 at the end wall 98, a shelf 102 in the center chamber 94 that divides the center chamber 94 into an upper area 104 and a lower area 106, and a top lid, such as top 90 or top 108. The top 108, in the embodiment shown, has two movably mounted lids; a first pivotably balanced lid 110 and a second lid 112. A first trash bag 40 can be used under the first lid 110 for collecting and storing ordinary trash. A second trash bag 40*a* can be used under the second lid 112 for collecting and storing special trash such as compostable material.

The units 72 and 74 each have a back wall 114 and 116 that abut each other. Suitable means are provided to securely but removably connect the two units together. Thus, each of the units 72 and 74 can be used and located either together or separately if desired. The units 72 and 74 can also be sold separately such that center 70 can be expanded modularly as needed. The side walls-of the units 72 and 74 could also be adapted to be connected to additional units such that more than two units can be connected together. The commingled recycling bin 84 might also be replaced with a cart having more than one collection area. The recycling unit might also have a plurality of doors in its sides in such an alternate embodiment.

Figure 3:
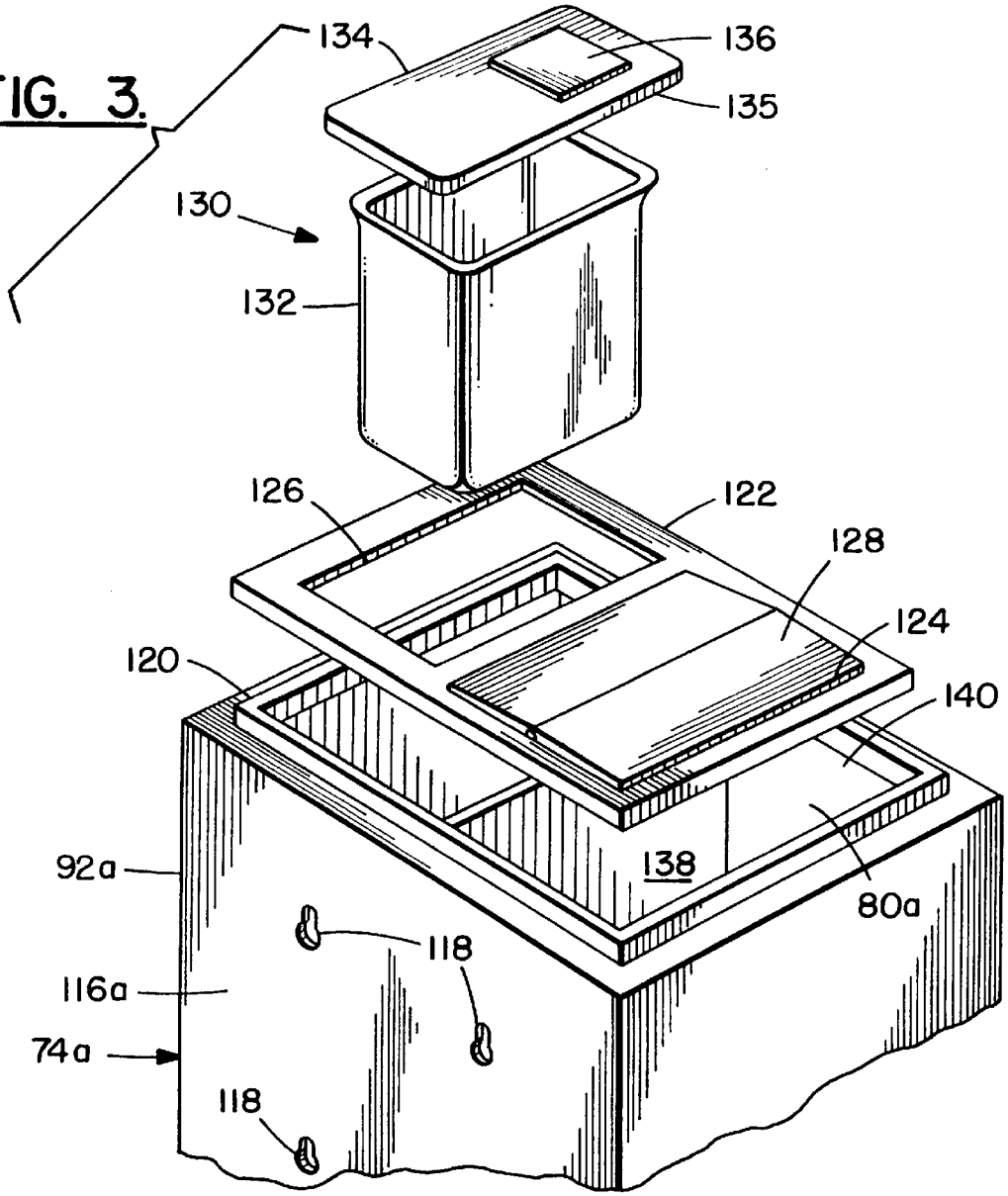
FIG. 3 is a partial exploded perspective view of an alternate embodiment of the present invention.

Referring now to FIG. 3, a partial exploded perspective view of an alternate embodiment of the trash unit 74 shown in FIG. 2 is shown. In the embodiment shown, the back wall 116*a* has slots 118 that are used to receive connecting members (not shown) of a recycling unit to connect the two units together. However, any suitable type of means for connecting modular units together could be provided. The top of the frame 92*a* has a modular snap on mount 120 such that the top lid 122 can be relatively easily snapped onto the frame 92*a*. In a preferred embodiment, the top of the frame 92*a* is adapted to make a snap-fit friction engagement with the lid 122. The top lid 122 has a first aperture 124 and a second aperture 126. The first aperture 124 is adapted to receive balanced pivoting lid 128. The second aperture 126 is adapted to removably receive container 130 used to collect compostable materials.

The container or compost unit 130 comprises a container 132, made of a suitable material such as plastic, and lid 134 that can be removably connected to the container 132 and form an air tight seal therewith. The lid 134 has an integrally formed movable door 136. In the embodiment shown, the compost unit 130 can be positioned in the second aperture 126 and be supported on the top surface of the top lid 122 around the second aperture by its upper surrounding lip 135. Thus, the compost unit can merely rest on the lid 122 and is relatively easy to remove from and connect with the trash unit 74*a* to facilitate removal to a food preparation area or counter top for ease of collection. It also facilitates removal to an outdoor compost pile for emptying. Also in the embodiment shown, the trash unit 74*a* has a vertical partition 138 that extends from the open top 80*a* down to the center shelf. This establishes a trash collection area 140 for a trash bag under the lid 128 and, allows a separate area under the bottom of the compost unit 130 for storing unused trash bags for future use. The separate areas insure that, if there is any type of spill from a trash bag in the trash collection area 140, it does not contaminate unused trash bags.

Figure 4:
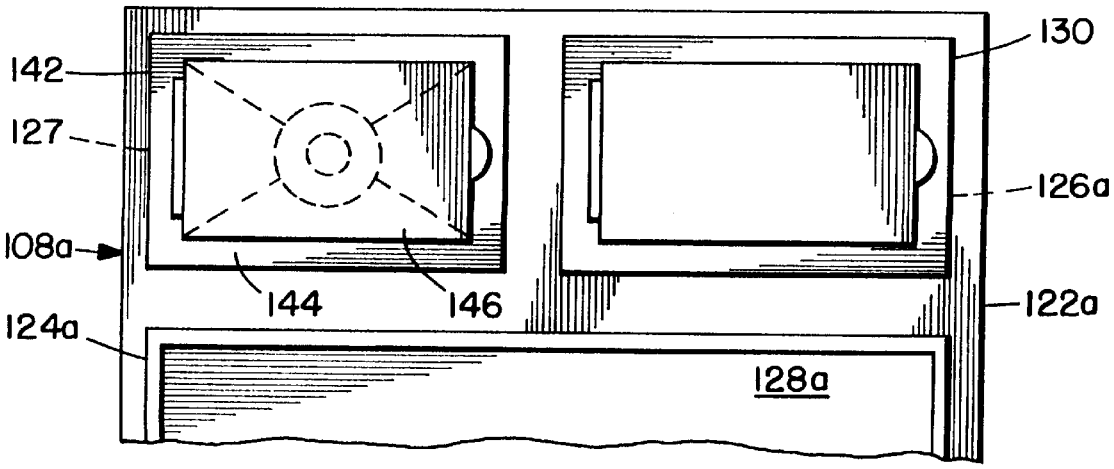
FIG. 4 is a partial plan top view of an alternate embodiment of the present invention.

Referring now to FIG. 4, there is shown a partial top view of an alternate embodiment of a trash unit top 108*a*. In the embodiment shown, the top 108*a* has a frame 122*a*, a compost unit 130, a movable lid 128, and a grease collection unit 142. The frame 122*a* has three apertures 124*a*, 126*a* and 127 for the lid 128*a*, container 130 and grease collection unit 142, respectively. The grease collection unit 142 is similar to the container 130 in that it has a container, a lid 144 that makes an air tight seal with its container, and a door 146 on the lid 144. A user can open the door 146 and deposit used cooking grease into the container and then reseal the collection unit 142. The collection unit 142 is removable from the top 108*a* and can thus be moved to a cooking or cleaning area and, when finished, returned to the trash unit. However, any suitable type of collection unit could be provided for any suitable type of material including other types of liquids. In a preferred embodiment, the unit is designed to use a discarded soup can or the like to collect waste grease. When full, the can of grease may then be disposed of and replaced by a new replacement discarded soup can.

Figure 5:
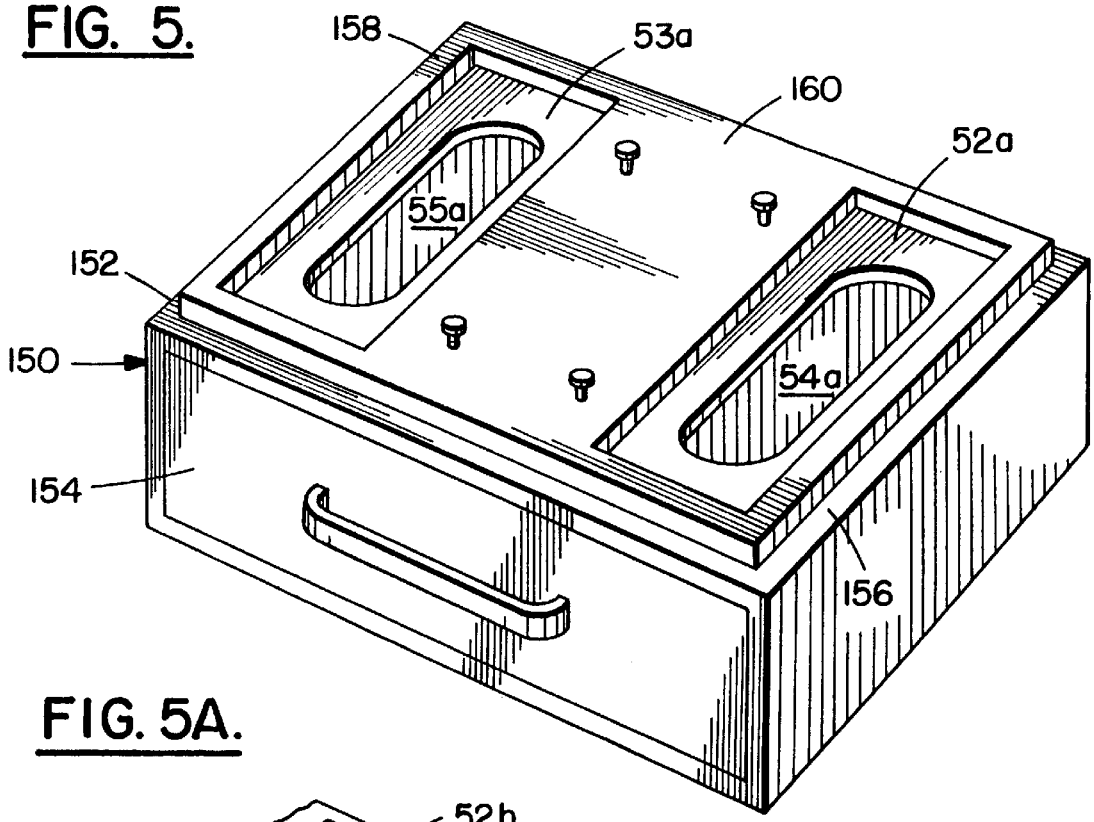
FIG. 5 is a perspective view of an alternate embodiment of the present invention.
Figure 5A:
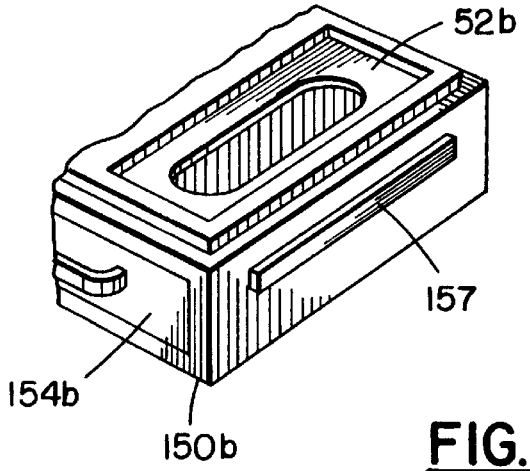
FIG. 5A is a partial perspective view of an alternate embodiment of the counter top unit shown in FIG. 5.

Referring to FIG. 5, there is shown a perspective view of a table top or counter top recycling unit 150. The counter top unit 150 can either be used alone, or may be combined with a recycling unit similar to the unit shown in FIG. 2. The counter top unit 150 comprises a frame 152 and a drawer 154. The drawer 154 is adapted to act as a container for recyclable articles. The frame 152 has a top 156 with two can staging areas 52*a* and 53*a*, slots 54*a* and 55*a* in each of the areas, a raised lip 158 that defines the staging areas, and a can crusher mounting area 160 adapted to removably receive a can crusher similar to the can crusher shown in FIG. 1. The counter top unit 150 is adapted for use in areas such as small apartments or at parties. In one embodiment of the invention, partially shown in FIG. 5A, the counter top unit 150*a* is adapted to be located on the top of a recycling unit and partially located in one of the chambers of the unit. The side ledge 157 is intended to rest on top of a unit frame to prevent the unit 150*a* from falling through the top aperture in the frame. This would allow a person with a counter top unit to expand to a full recycling unit by merely purchasing its frame and not having to purchase an additional top. When desired, the counter top unit 150*a* can be removed from its unit frame and moved to a selected location such as for use in a car or in a back yard.

Figure 6:
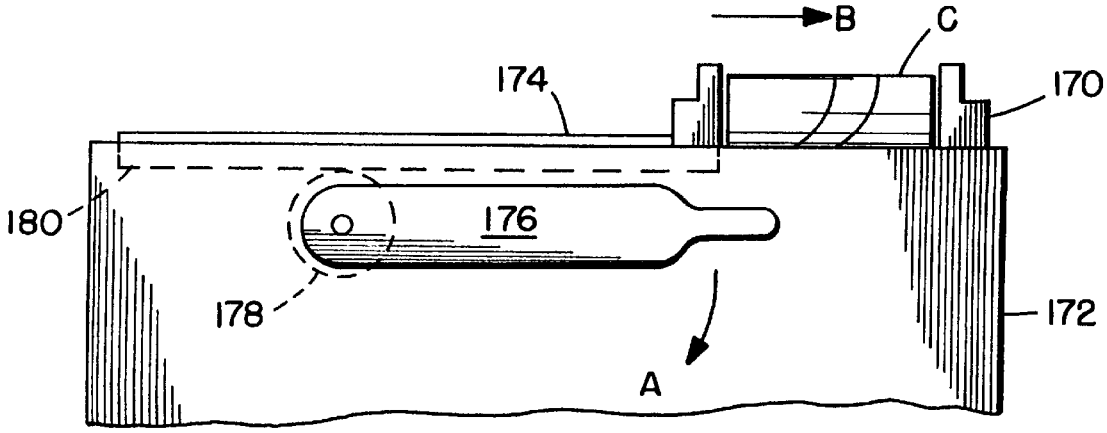
FIG. 6 is a plan side view of a top of an alternate embodiment of the present invention.

Referring now to FIG. 6, there is shown a partial plan side view of an alternate embodiment of the invention. In the embodiment shown, a recycling unit 72*b* is provided with an alternate form of can crusher. In the embodiment shown, the can crusher comprises a base 170 stationarily connected to the frame 172, a plunger/crusher 174, an operating lever 176, and a drive gear 178. The drive gear 178 is connected to the operating lever 176 such that as the lever 176 is moved, the gear 178 is rotated. The plunger/crusher 174 has a rack portion 180 adapted to be moved by the gear 178. Thus, as the lever 176 is moved in the direction A, the plunger/crusher 174 is moved by the gear 178 in the direction B to crush and compact a can C between the plunger/crusher 174 and base 170. However, any suitable type of crusher could be provided. Alternatively, no can crusher need be provided. The system of the present invention can also include other features provided as either additional modular units or integral to a housing or top such as a can opener, or a bottle opener, or a towel rack.

Figure 7:
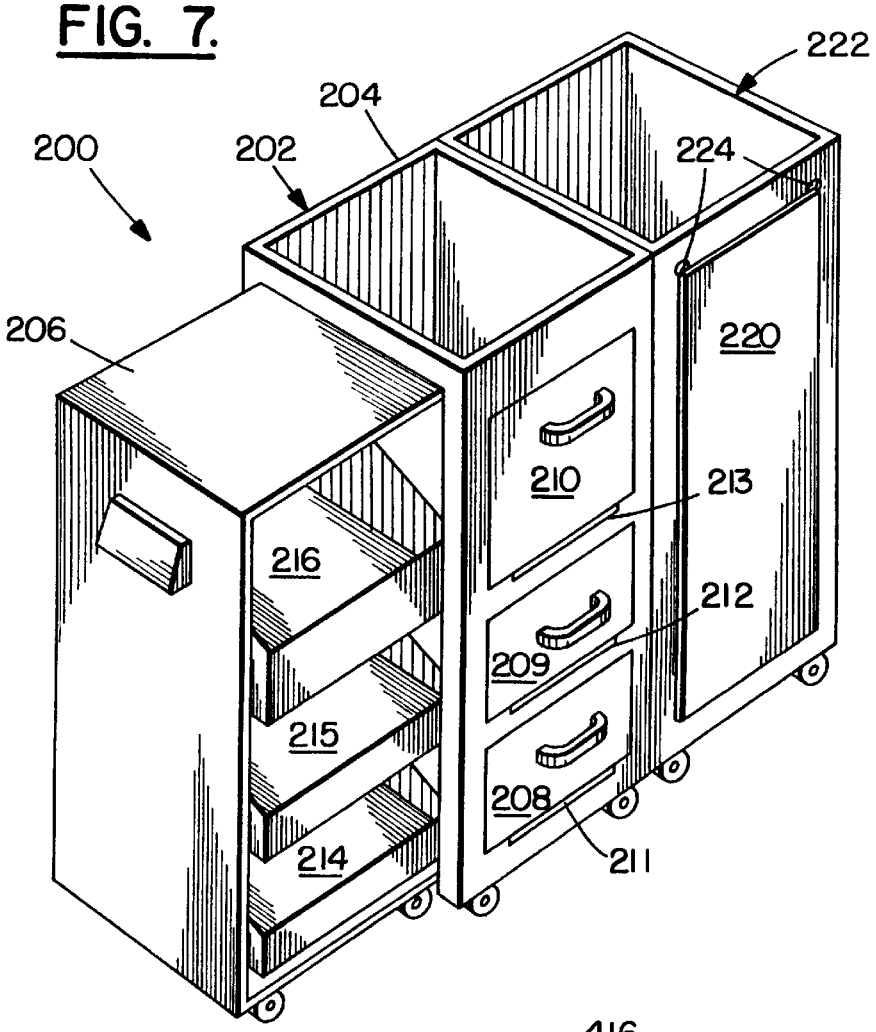
FIG. 7 is a partial perspective view of an alternate embodiment of the present invention.

Referring to FIG. 7, an alternate embodiment of the invention is shown. In the embodiment shown, the center 200 (shown without a top) has a recycling unit 202 with a frame 204 and a removable cart 206. The frame 204 has three pivotably mounted side doors 208, 209, 210 that have hinges 211, 212, 213. The cart 206 has three levels of shelves with containers 214, 215, 216 on each shelf. A user can deposit different types of recyclable materials in each one of the containers 214, 215, 216 by using the separate side doors 208, 209, 210. The cart 206 can be removed from the center 200 with all three containers and moved to a predetermined area when full, such as to a curbside, or the individual containers 214, 215, 216 can be separately removed from the center 200. Also shown in this embodiment is a poster board 220 that is removably connected the trash unit 222 by hangers 224. The poster board 220 is for decorative purposes and need not be provide. In an alternate embodiment, the poster board 220 may be provided in a sufficiently large enough size to substantially cover the sides of both the units 202 and 222 and cover the seam therebetween. Rather than a poster board, the unit could have a message board, or a task scheduling board, or a game or reward system for teaching of rewarding children to encourage recycling.

Although the above described embodiments have been described with reference to a "household" type of unit, it should be understood that the present invention can be used in any suitable location. For example, the invention is suited for use in any food or beverage preparation, usage, or consumption area, or an office cantina area. The present invention can also be adapted for medical waste sorting and collection or any number of additional waste generation or disposal locations.

Figure 8A:
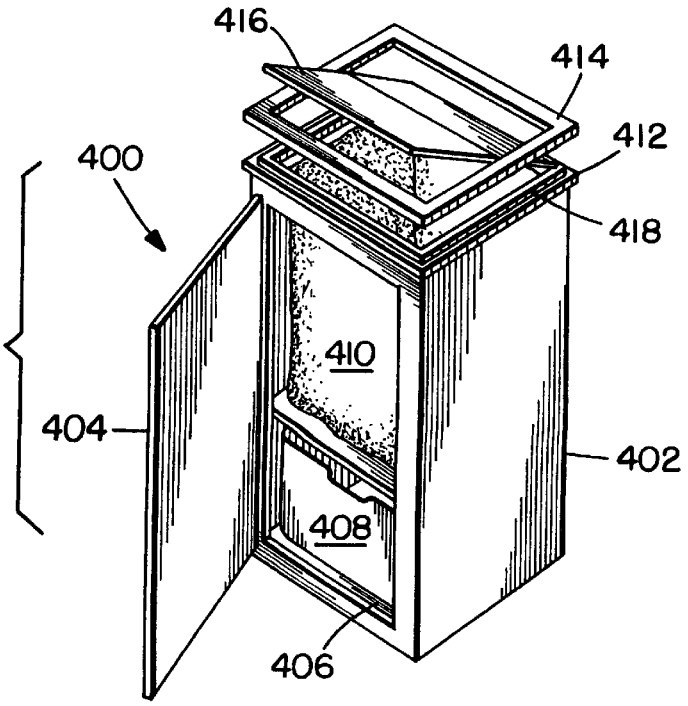
FIG. 8*a* is an exploded perspective view of an alternate embodiment of the present invention.
Figure 8B:
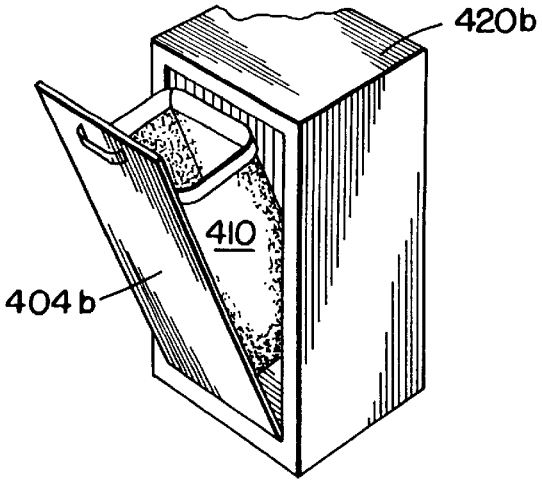
FIG. 8*b* is a partial perspective view of an alternate embodiment of the embodiment shown in FIG. 8*a*.
Figure 8C:
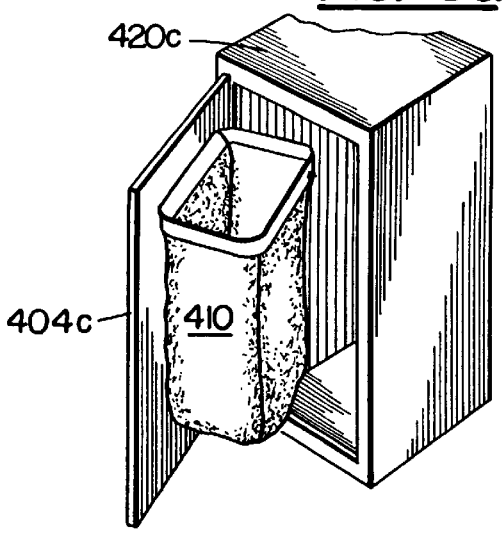
FIG. 8*c* is a partial perspective view of and alternate embodiment of the embodiment shown in FIG. 8*b*.

Referring to FIGS. 8*a*, 8*b*, and 8*c*, there are shown three more embodiments of recycling units. In FIG. 8*a*, the unit 400 is adapted to receive a blue bag 410. The term "blue bag" as used herein is intended to mean a plastic bag that is intended to receive recyclable material and has a blue color for easy identification. The unit 400 has a housing 402 with a door 404, a bottom area 406 for receiving a removable collection container 408, a top area for locating the blue bag 410, and a top 412. The unit 400 has a lid 414 with a flap 416. The top 412 has a mounting ring 418. The lid 414 sits down over the mounting ring 418 with the upper portion of the blue bag therebetween to keep the blue bag in place and open to accept articles. FIGS. 8*b* and 8*c* show two different embodiments where the blue bags 410 are mounted to the doors 404*b* and 404*c*. These two embodiments allow for the top surfaces 420*b* and 420*c* of the units to be used for alternative purposes, such as an extra counter top or for mounting a can crusher to the units.

Figure 9:
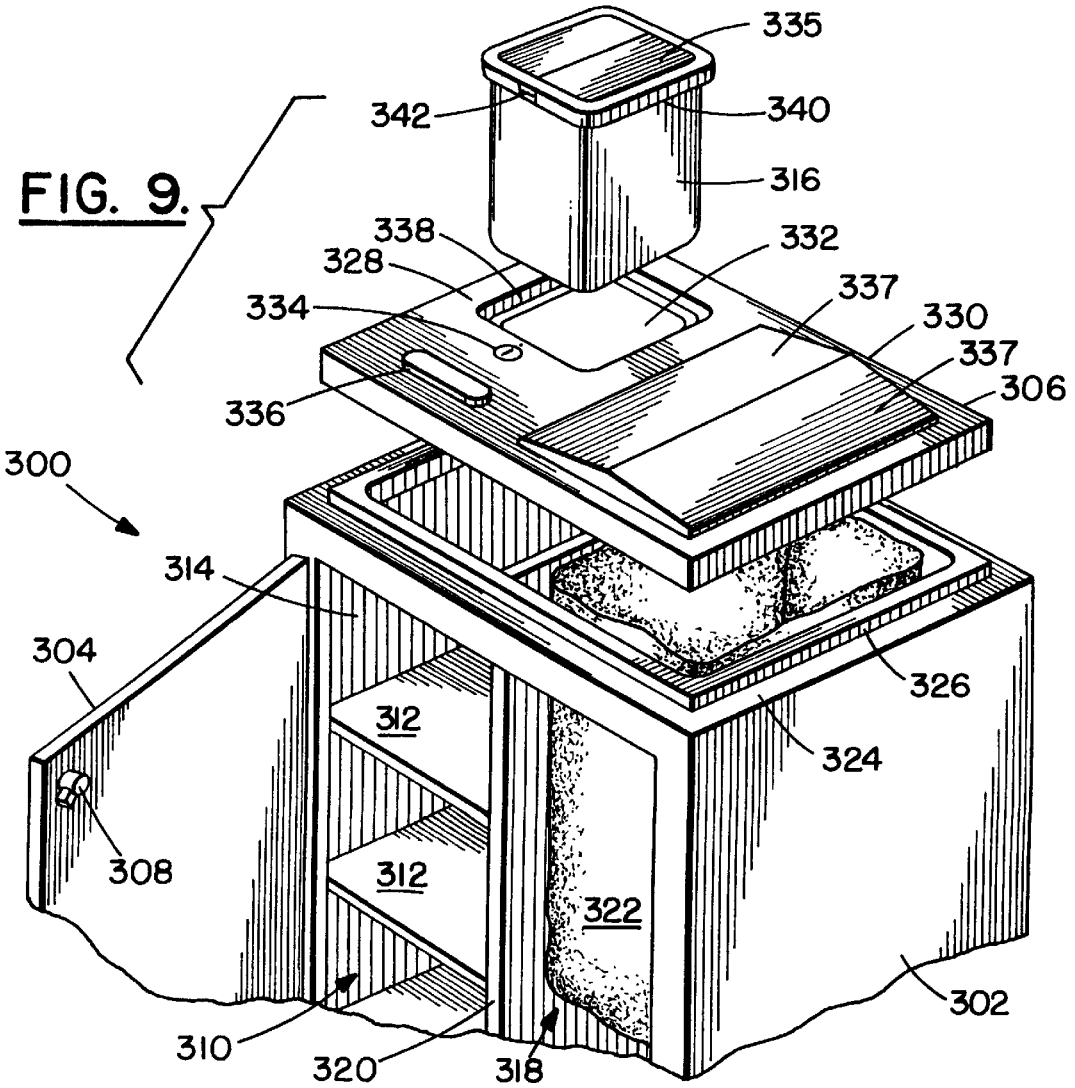
FIG. 9 is an exploded perspective view of an alternate embodiment of the present invention.

Referring now to FIG. 9, there is shown one embodiment of a trash center 300 incorporating features of the present invention for use in a medical environment. The center 300 has a housing 302, an access door 304 for access into the interior of the housing 302, and a top 306. The door 304 is mounted to the housing 302 by a hinge and has a lock 308 to restrict access to the interior of the housing 302 by means of the door 304. The housing 302 may be free standing, have rollers for mobility, or be fixedly mounted to a wall. The housing 302 may also be suitably adapted to be modularly connected to another trash center. In the embodiment shown, the interior of the housing 302 has a first section 310 with shelves 312. The first section 310 is adapted to store supplies of articles such as red bags and safety containers for sharps. As used herein, the term "red bag" is intended to mean a plastic bag that is colored red. In the medical profession red bags are used to collect "red bag waste". As used herein, the term "red bag waste" is intended to mean potentially hazardous medical waste, such as waste that has come into contact with human blood, which is only collected in red bags for ease of identification and proper sanitary and safe disposal. The term "sharps" as used herein is intended to mean potentially hazardous medical waste that could puncture or penetrate a person's skin, such as scalpel blades, syringes, needles, etc. Sharps are usually collected separately from red bag waste in a rigid container so as to collect the sharps without substantial risk of a subsequent handler of the sharps container being inadvertently injured by the sharps. Various sharps containers are known in the medical profession.

In the embodiment shown, the upper area 314 of the first section 310 is intended to partially house a sharps container 316 in active use with the center 300. The interior of the housing 302 also has a second section 318 with a divider 320 between the first and second sections. The second section 318 is generally adapted to hold a red bag 322 in active use. Suitable means may be provided to hold the red bag 322 open and to provide for easy installation and removal of the red bag from the second section 318. The upper surface 324 of the housing 302 has a raised section 326 for mounting the top 306 to the upper surface 324. Suitable means may be provided to fixedly mount the top 306 to the upper surface 324 or, the top 306 may be integrally formed with the housing 302. As can be seen, below the top 306 the top surface of the housing 302 is open to allow articles, when passed through the top 306, to be placed in the red bag 322 and to allow a bottom portion of the sharps container 316 to be positioned in the upper area 314 of the first section.

The top 306 has a first section 328 and a second section 330. The first section 328 is intended to be located over the first section of the interior of the housing 302 and has an aperture 332, a lock 334 and a button 336 for actuating the doors 337 over the red bag 322 and/or an odor control device. The aperture 332 has a seat 338 such that a top rim 340 of the sharps container 316 can rest thereon. The sharps container 316 also has a lock slot 342 which, when positioned in and on the top 306, is adapted to receive a lock latch of the lock 334 to fixedly but removably mount the sharps container to the top 306. The sharps container 316 also has suitable doors 335. The second section 330 has, in the embodiment shown, two doors 337 that are located over the red bag 322. The button 336 actuates the opening and closing of the doors 337 for depositing red bag waste in the red bag and, for keeping access to the red bag 322 closed when not in use. Of course, the doors to the sharps container 316 and doors 337 may be as complex or as simple as desired. In addition, the locks 308 and 334 need not be provided or any suitable locking system could be provided.

Figure 10A:
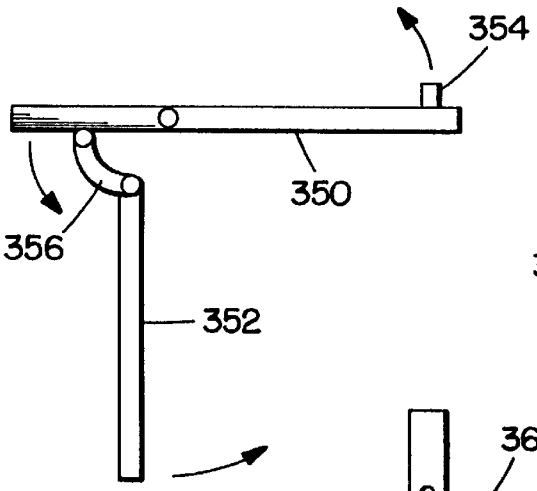
FIG. 10*a* is a schematic side view of a door system for use with the embodiment shown in FIG. 9.
Figure 10B:
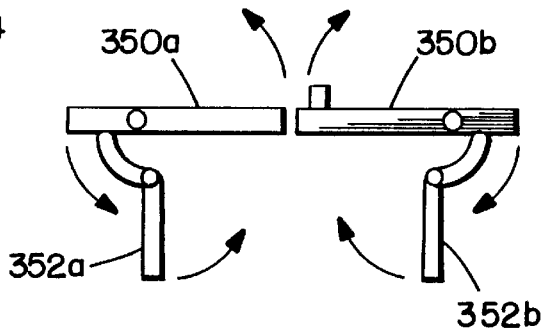
FIG. 10*b* is a schematic side view of a door system for use with the embodiment shown in FIG. 9.

Referring also to FIGS. 10*a* and 10*b*, there are shown two different door embodiments for use in the second section 330 of the top 306. In the first embodiment shown in FIG. 10*a*, the door system has a top door 350 and a bottom door 352. The top door 350 has a handle 354 for manually opening the top door 350. A lever 356 interconnects the top door 350 to the bottom door 352. The bottom door 352 is located in a down position when the top door 350 is in its closed position relative to the frame of the top. When the top door 350 is opened, the lever 356 moves the bottom door 352 towards a horizontal position. Thus, the user merely places the red bag waste on the bottom door and, when the top door 350 is closed, the bottom door returns to its vertical position allowing the red bag waste to merely drop into the red bag. This prevents direct access to the interior of the red bag even when the top door 350 is open. The second embodiment shown in FIG. 10*b* shows a similar system with two upper doors 350*a* and 350*b* and, two lower doors 352*a* and 352*b*. Suitable means are provided such that when a user opens the door 350*a*, the door 350*b* also moves open. In an alternative embodiment, a foot peddle mechanism might be provided to open the upper doors.

Figure 11A:
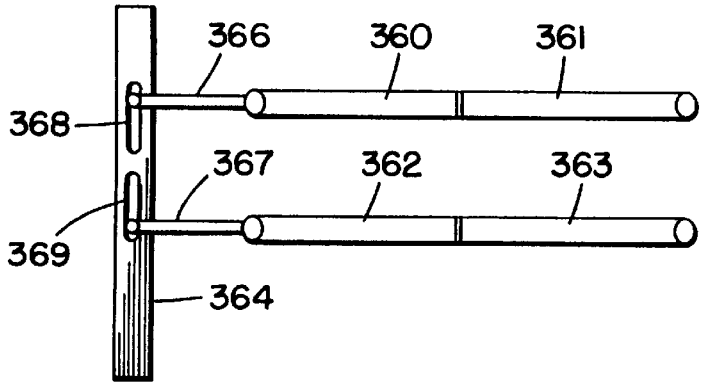
FIG. 11*a* is a schematic side view of a door system for use with the embodiment shown in FIG. 9 with its doors in a closed position.
Figure 11B:
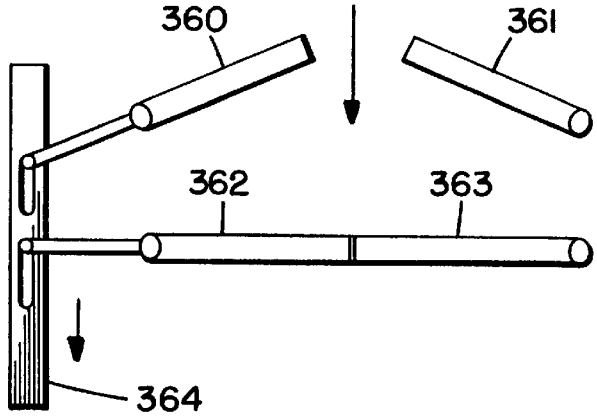
FIG. 11*b* is a schematic side view of a door system as shown in FIG. 11*a* with its upper doors open and its lower doors closed.
Figure 11C:
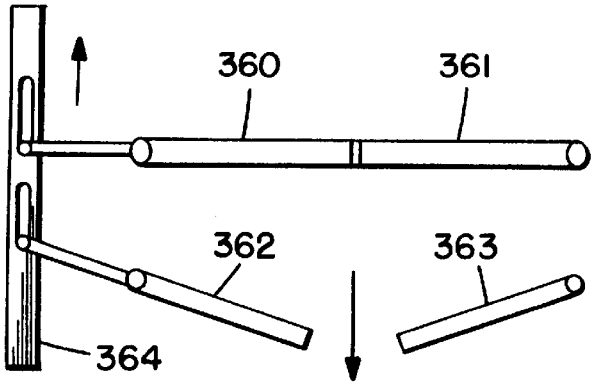
FIG. 11*c* is a schematic side view of a door system as shown in FIG. 11*a* with its upper doors closed and its lower doors open.

Referring also to FIGS. 11*a*, 11*b*, and 11*c*, there is shown another alternative embodiment of a red bag access door system for use with the center 300 shown in FIG. 9. In the embodiment shown, the door system has an upper pair of doors 360 and 361, a lower pair of doors 362 and 363, and a control lever 364. The upper pair of doors are operably connected to each other to move in unison. Likewise, the lower pair of doors 362 and 363 are also operably connected to each other to move in unison. The doors 360 and 362 are pivotally mounted to the frame of the top and have extensions 366 and 367. The control lever 364 has two slots 368 and 369, one for each extension to project into. FIG. 11*a* shows the doors 360–363 in their normal closed position. When the control lever 364 is pushed down as shown in FIG. 11*b*, the upper doors open, but the lower doors remain closed. Red bag waste can then be inserted through the opening onto the lower doors 362 and 363. The lever 364 is then released to close the upper doors 360 and 361. In an alternative embodiment, disinfectant can be injected into the area between the upper and lower doors when the upper doors 360 and 361 are closed. After the upper doors are closed, the user can then merely pull on the control lever 354 which opens the lower doors 362 and 363 to allow the red bag waste to drop into the red bag as shown in FIG. 11*c*. The upper doors remain closed. When the control lever is released, the lower doors 362 and 363 are biased back to a closed position by a suitable spring mechanism. Thus, direct access through the door system to the red bag is restricted.

Let it be understood that the foregoing description is only illustrative of the invention. Various alter natives and modifications can be devised by those skilled in the art without departing from the spirit of the invention. Accordingly, the present invention is intended to embrace all such alternatives, modifications and variances which fall within the scope of the appended claims.

What is claimed is:

1. A recycling receptacle comprising:

a housing having a top and side walls forming an interior storage area, said housing having a slot therethrough for transporting articles into said interior area and an article staging area for temporarily storing a plurality of articles on said top prior to insertion into said slot, said staging area including a raised lip; and at least one container removably positioned in said interior area for receiving articles deposited into said interior area through said slot.

2. A receptacle as in claim 1 wherein said slot is in said housing top.

3. A receptacle as in claim 2 wherein said raised lip substantially surrounds said slot.

4. A receptacle as in claim 1 further comprising a can crusher connected to said housing.

5. A receptacle as in claim 4 wherein the can crusher is connected to a top surface of the top of the housing.

6. A receptacle as in claim 5 wherein the slot extends through the top surface of the top, wherein the top surface comprises a second slot for passing articles through the second slot into the at least one container, and wherein the can crusher is located between the two slots.

7. A receptacle as in claim 6 wherein the top surface comprises the staging area and the top surface also comprises a second staging area which includes a second raised lip.

8. A receptacle as in claim 7 wherein the slots extend through respective ones of the staging areas.

9. A receptacle as in claim 4 wherein the can crusher comprises a can crushing lever pivotably connected to the top of the housing.

10. A receptacle as in claim 9 wherein the top of the housing comprises a can crusher base with a recess located under the lever.

11. A receptacle as in claim 9 wherein the can crushing lever is pivotably connected to a top surface of the top of the housing.

12. A receptacle as in claim 1 wherein said housing includes a side door for accessing said interior area.

13. A receptacle as in claim 1 wherein the top of the housing comprises a top surface, and wherein the article staging area is located on the top surface.

14. A receptacle as in claim 13 wherein the slot extends through the top surface.

15. A receptacle as in claim 14 wherein the raised lip extends in an upward direction from the top surface.

16. A receptacle as in claim 1 wherein the top of the housing comprises a top surface and wherein the slot extends through the top surface.

17. A receptacle as in claim 1 wherein the top of the housing comprises a top surface and wherein the raised lip extends in an upward direction from the top surface.

18. A receptacle as in claim 17 wherein the article staging area is located on the top surface.

19. A receptacle as in claim 17 wherein the slot extends through the top surface.

20. A receptacle as in claim 1 wherein the top further comprises an aperture through a top surface of the top and a lid movably located in the aperture.

* * * * *